US007305774B1

(12) United States Patent
Whaley

(10) Patent No.: US 7,305,774 B1
(45) Date of Patent: Dec. 11, 2007

(54) DECK BOARD POSITIONING TOOL

(76) Inventor: Frank Whaley, 10207 Cedro Rd., Nevada City, CA (US) 95959

( * ) Notice: Subject to any disclaimer, the term of this patent is extended or adjusted under 35 U.S.C. 154(b) by 0 days.

(21) Appl. No.: 11/387,185

(22) Filed: Mar. 22, 2006

(51) Int. Cl.
*G01B 5/16* (2006.01)

(52) U.S. Cl. ..... 33/613; 33/526

(58) Field of Classification Search ..... 33/526, 33/527, 613, 645
See application file for complete search history.

(56) References Cited

U.S. PATENT DOCUMENTS

| | | | | |
|---|---|---|---|---|
| 3,735,497 | A | 5/1973 | Boettcher | |
| 4,850,114 | A | 7/1989 | Vockins | |
| 4,955,142 | A | 9/1990 | Rieck | |
| 5,288,534 | A * | 2/1994 | Tavshanjian | 33/526 |
| 5,560,117 | A | 10/1996 | Tallman | |
| 6,508,010 | B2 | 1/2003 | Hanson et al. | |
| 6,510,621 | B2 | 1/2003 | Camara et al. | |
| 6,539,641 | B2 | 4/2003 | Belliveau | |
| 6,647,638 | B1 | 11/2003 | Doyal | |
| 6,895,684 | B1 * | 5/2005 | Firth | 33/613 |
| 6,915,590 | B2 | 7/2005 | Chillington | |
| 2002/0121027 | A1 * | 9/2002 | Kruskamp | 33/526 |
| 2005/0268752 | A1 * | 12/2005 | Johnson et al. | 81/177.4 |

* cited by examiner

*Primary Examiner*—G. Bradley Bennett
(74) *Attorney, Agent, or Firm*—Heisler & Associates

(57) ABSTRACT

A tool is provided for sizing a gap between adjacent deck boards or other objects. The tool includes a primary element of elongate rigid form and a secondary element affixed to the primary element. The secondary element is adapted to be placed within a gap to be sized. The secondary element has a cross-section which exhibits a greater thickness in a first direction than in a second direction. This tool is used in a gap sizing method, typically with multiple similar tools, where the tool is first oriented with a greater thickness aligned with adjacent objects on each side of the gap. The tool is then rotated about a long axis of the secondary element to exhibit lesser thickness and facilitate easy removal of the tool from the gap.

20 Claims, 3 Drawing Sheets

DECK BOARD POSITIONING TOOL

FIELD OF THE INVENTION

The following invention relates to tools for properly spacing objects from each other. More particularly, this invention relates to tools for properly positioning deck boards and similar objects so that a uniform gap thickness is provided between adjacent objects, such as deck boards which are included upon an upper surface of a deck, typically adjoining an exterior of a residential structure.

BACKGROUND OF THE INVENTION

Residential structures often benefit from including a deck adjacent thereto. Such decks are typically located outside of the residential structure and act to expand overall useful space of the residence and tend to join an exterior landscape with interior space of the residential structure.

Such decks typically include a plurality of joists oriented parallel to each other and either supported from below by girders or other structural members, or suspended from the residential structure (or both). Decking material, often in the form of deck boards, are placed upon the joists, typically perpendicular to the joists. These deck boards or other decking materials provide the surface upon which occupants can stand when utilizing the deck, and upon which furniture and other decorative items are typically placed.

Because decking structures are typically formed from dimensional lumber or other wood containing materials, the integrity and lifespan of the deck is enhanced by maintaining a gap between adjacent deck boards. Specifically, when water strikes the deck boards it is important that the water not be in any way encouraged to reside for indefinite periods of time adjacent the various decking materials. If the deck boards are adjacent each other, moisture can reside between the deck boards and cause the deck boards (and also the joists) to prematurely decay. Most properly designed decks thus call for a standard gap width between adjacent deck boards.

On most decks this gap width is either ¼ inch or ⅜ inch. While the gap could be wider or smaller (for instance some composite decking material specifies a ⅛ inch gap width) and could vary, decks typically benefit aesthetically by having gaps which are of uniform width. Accordingly, a need exists for this gap to be efficiently and properly provided as the deck boards are being installed.

Numerous products exist in the prior art which are directed to the general goal of assisting a deck board installer in maintaining proper gap width between adjacent deck boards. For instance, U.S. Pat. Nos. 3,735,497; 4,850,114; 4,955,142; 5,560,117; 6,508,010; 6,510,621; 6,539,641; 6,647,638; and 6,915,590 provide various prior art attempts to address this need.

One problem exhibited by most if not all of the prior art deck board positioning prior art is the difficulty in removing the prior art devices after adjacent deck boards have been fastened in place. In particular, to make the gap of uniform width it is desirable to place the boards snugly together with only the gap sizing tool therebetween. Once the boards have been fastened to underlying joists, the gap sizing tool is often wedged tightly between the deck boards. Accordingly, a need exists for a deck board gap sizing tool which can be readily removed after use.

Also, it would be beneficial to provide a gap sizing method which allows multiple gaps between multiple adjacent boards to be sized initially in an overall deck layout step with simple gap sizing tools which can be used together in a large set, and preferably be adjustable to provide varying width gaps and be readily removable after use.

SUMMARY OF THE INVENTION

With this invention a tool is provided which can be used in a group to size gaps between adjacent deck boards or other objects, or optionally be used alone. Each tool is preferably similar and includes a primary element and a secondary element affixed together. These elements are typically perpendicular to each other and formed of a rigid material. The secondary element preferably includes a greater thickness in a first direction than a thickness exhibited in a second direction. In utilizing the tool, the secondary element is placed within the gap between adjacent deck boards and with the greater thickness in the first direction of the second element extending between the adjacent deck boards. When the boards have been secured where desired, the tool can be rotated about a long axis of the secondary element so that the greater thickness in the first direction of the secondary element is rotated out of abutment with the adjacent deck boards, leaving the lesser thickness in the second direction of the secondary element adjacent the two deck boards, in which orientation the tool can be easily translated along the long axis of the secondary element for removal from the gap.

In a most preferred form of the invention, a tertiary element is also provided extending from the primary element. This tertiary element is preferably located at an end of the primary element opposite the secondary element and preferably perpendicular to both the primary element and the secondary element. The tertiary element is preferably similar in form to the secondary element except that it is sized to exhibit a different thickness when utilized within a gap between adjacent deck boards. Thus, the single tool in this preferred embodiment can be utilized both for sizing a smaller gap or a larger gap, such as for example a ¼ inch gap or a ⅜ inch gap between adjacent deck boards.

The varying thicknesses exhibited by the cross-sections of the secondary element and tertiary element are most preferably provided by forming cross-sections of the secondary element and tertiary element generally as circular in form over portions thereof and with flattened sections on opposite sides of the secondary element and the tertiary element. The curving sections are preferably aligned in a plane including the primary element and define the width for the gap between adjacent boards when that element is placed between the adjacent boards. When the tool is to be removed, the tool is rotated until the flat sides of either the secondary element or tertiary element between the deck boards are rotated into position adjacent the deck boards, so that this lesser thickness of either the secondary element or tertiary element allows for easy removal of the tool from the gap.

OBJECTS OF THE INVENTION

Accordingly, a primary object of the present invention is to provide a tool for properly sizing a gap between deck boards or other objects.

Another object of the present invention is to provide a gap sizing tool which can accurately size a gap between two adjacent objects and be readily removed after use.

Another object of the present invention is to provide a gap sizing tool which can be utilized within a large set of similar tools for laying out of long gaps and multiple gaps such as exist within a deck including multiple adjacent deck boards with gaps therebetween.

Another object of the present invention is to provide a deck board gap sizing tool which can properly size gaps of at least two different sizes with a single such tool.

Another object of the present invention is to provide a gap sizing tool which is of simple construction and which exhibits a high degree of dimensional stability and precision sizing.

Another object of the present invention is to provide a gap sizing tool which lends itself to construction from injection molding, bending, casting, pressing, and other mass manufacturing techniques.

Another object of the present invention is to provide a deck board gap sizing tool which can be used in a large set to both properly size gaps between adjacent deck boards and align fasteners passing through the deck boards.

Other further objects of the present invention will become apparent from a careful reading of the included drawing figures, the claims and detailed description of the invention.

DESCRIPTION OF THE PREFERRED EMBODIMENT

Figure 1:
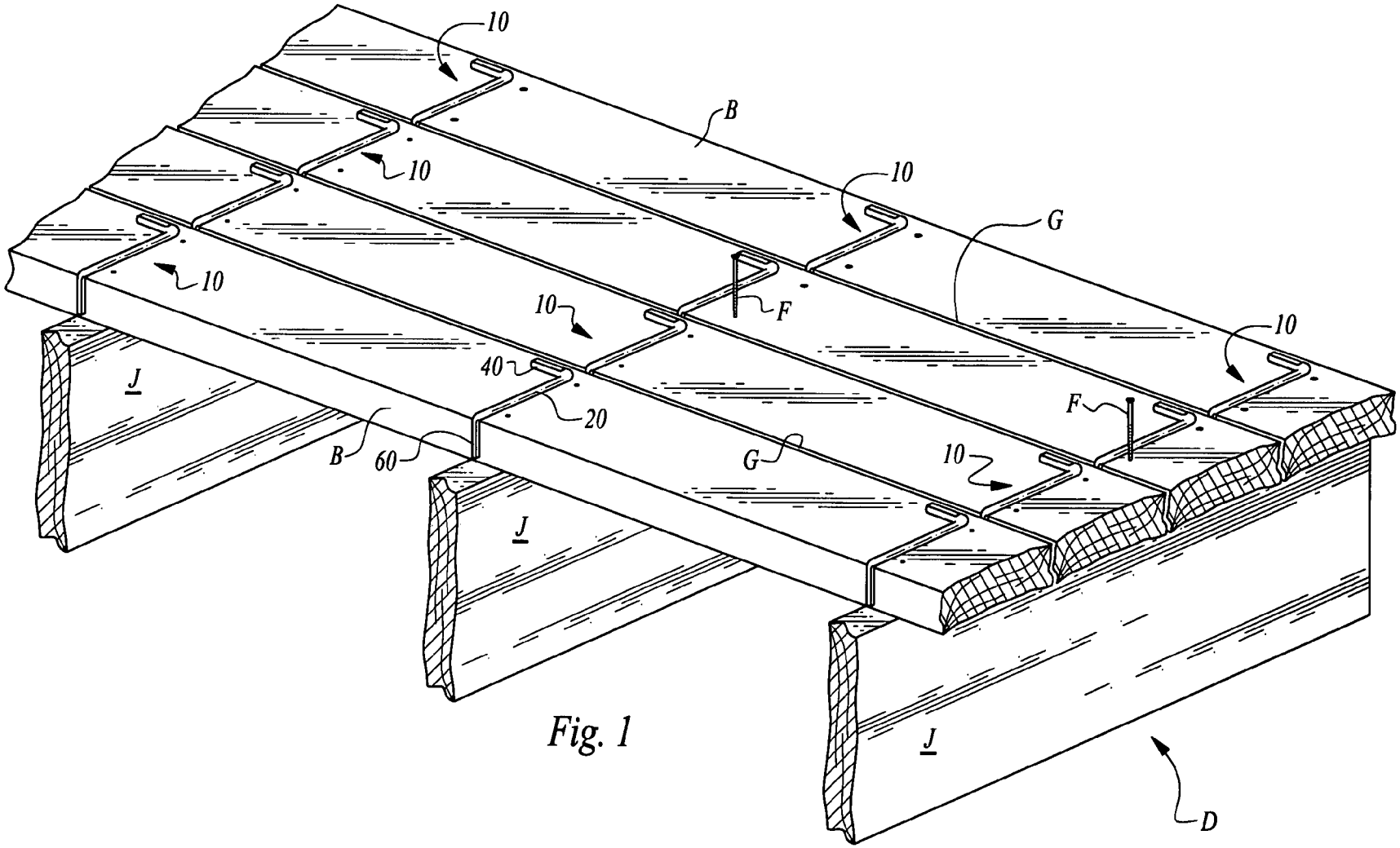
FIG. 1 is a perspective view of a deck in the process of being manufactured with gaps between adjacent deck boards sized by utilization of a set of tools according to a method of this invention and utilizing a tool according to a preferred embodiment of this invention.

Referring to the drawings, wherein like reference numerals represent like parts throughout the various drawing figures, reference numeral 10 is directed to a positioning tool (FIGS. 1 and 2) for sizing gaps G between adjacent objects, and particularly deck boards B. The tool 10 is typically used within a group of positioning tools 10 (FIG. 1) to lay out the position of deck boards B and associated gaps G therebetween before fasteners F, such as screws, are utilized to secure the deck boards B to underlying joists J or other structural members in construction of the deck D. Alternatively, the positioning tool 10 can be used by itself in isolation or in smaller sets of similar positioning tools 10. Once the positioning tools 10 have been utilized, a method is provided according to this invention to facilitate easy removal of the positioning tool 10 (FIG. 5) by first rotating (along arrow A of FIG. 5) and then translating (along arrow C of FIG. 5) for efficient tool 10 removal.

Figure 2:
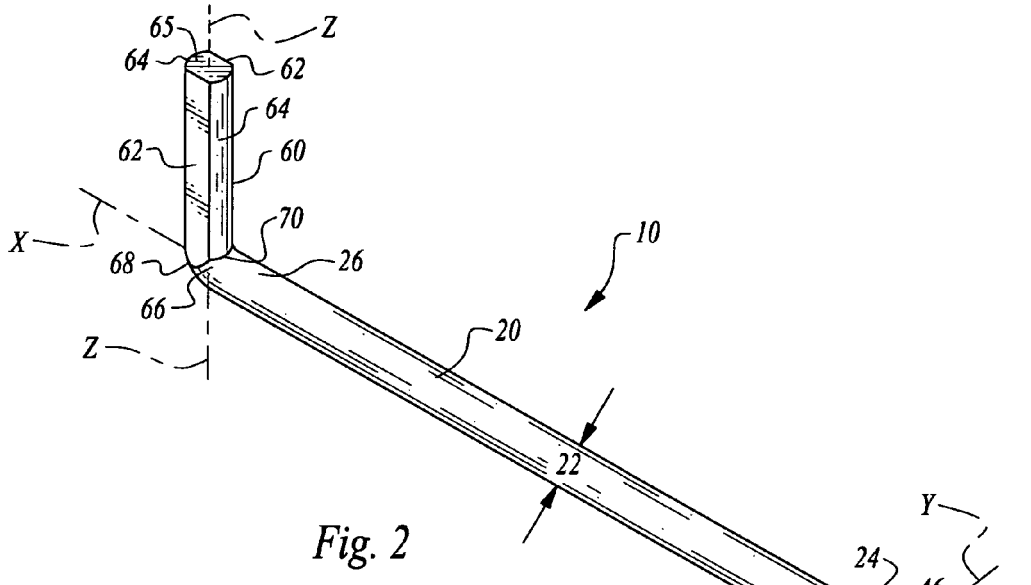
FIG. 2 is a perspective view of a single one of the gap sizing tools of this invention shown in FIG. 1.

In essence, and with particular reference to FIG. 2, basic details of the positioning tool 10 are described according to a preferred embodiment. The positioning tool 10 is preferably in the form of three separate elements either joined together from separate parts or initially formed together from a unitary mass of material. These elements include a center leg 20 which is preferably a longest of the three elements. A wider leg 40 extends from the center leg 20, preferably at an end of the center leg 20. A narrower leg 60 preferably also extends from the center leg 20, and preferably from an end of the center leg 20 opposite the wider leg 40. Preferably, the wider leg 40 and narrower leg 60 are each perpendicular to the center leg 20. Most preferably, the wider leg 40 and narrower leg 60 are also preferably perpendicular to each other.

Both the wider leg 40 and narrower leg 60 are preferably constructed to have a unique cross-sectional contour. This cross-sectional contour is sized and shaped to be thicker in a first direction than in a second direction. The thicker first direction defines the gap width between adjacent deck boards B (FIG. 1). The second narrower direction for each leg 40, 60 defines a narrower release thickness which can be aligned with the adjacent deck boards B (FIG. 1) after rotation of the center leg 20 (along arrow A of FIG. 5) for easy removal of the positioning tool 10 (along arrow C of FIG. 5).

Figure 3:
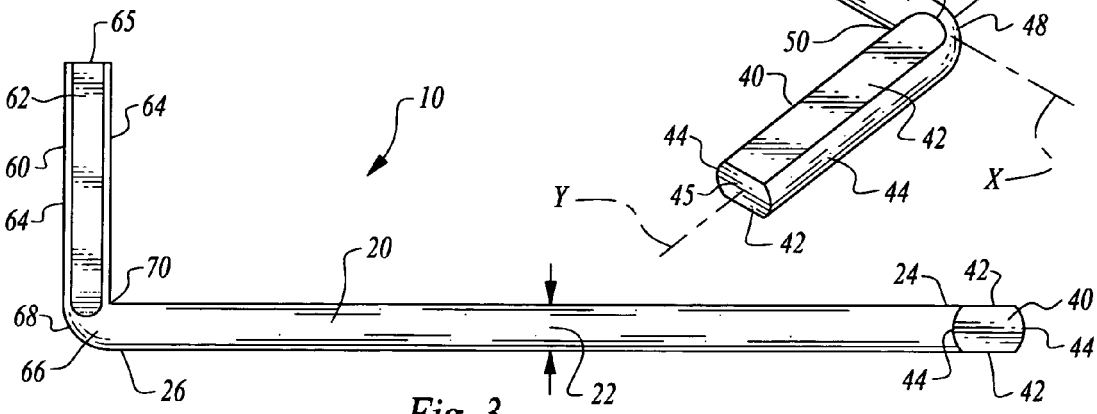
FIG. 3 is a front elevation view of that which is shown in FIG. 2 and in an orientation generally rotated 180° (about the X axis) away from an orientation in which the tool would typically be used, such as shown in FIG. 1.
Figure 4:
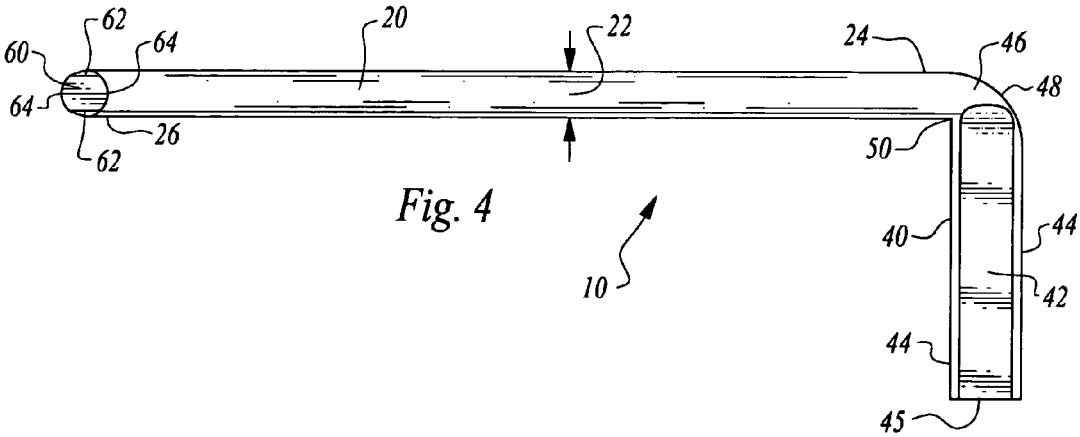
FIG. 4 is a top plan view of that which is shown in FIG. 2.
Figure 5:
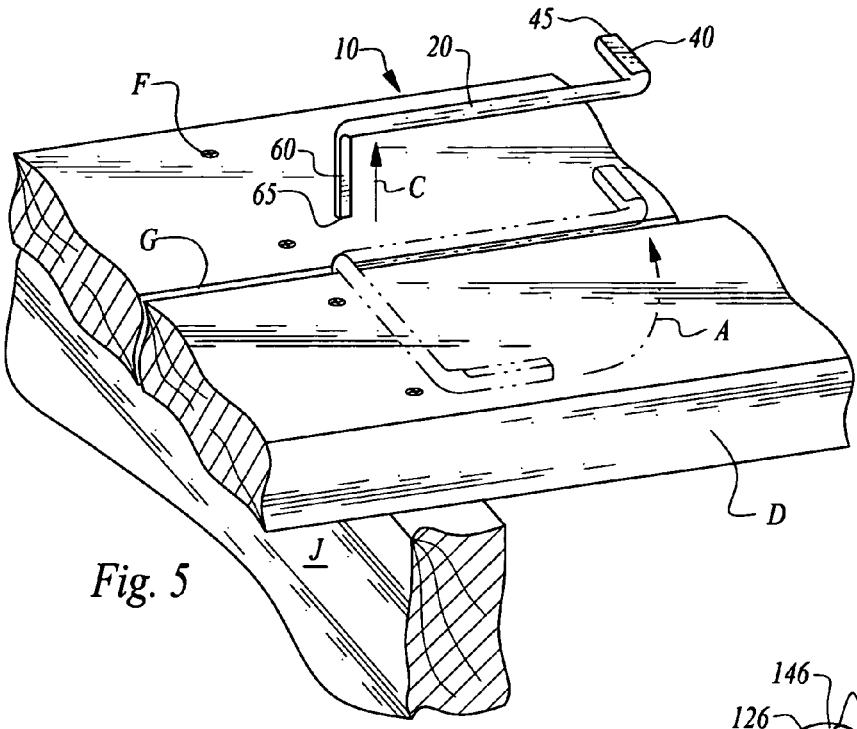
FIG. 5 is a perspective view of a portion of that which is shown in FIG. 1 and illustrating the steps associated with removal of the tool from the gap between adjacent deck boards, according to a method of this invention.

More specifically, and with particular reference to FIGS. 2-4, details of the center leg 20 of the positioning tool 10 are described. The center leg 20 defines a portion of the positioning tool 10 which typically does not enter into the gap G between adjacent boards B (FIG. 1), but rather rests upon a top surface of one of the deck boards B (FIG. 1). This center leg 20 could exhibit a variety of different contours, but is most preferably substantially linear. This center leg 20 is preferably rigid or at least sufficiently rigid so that it can be utilized to rotate the entire positioning tool 10, such as during removal (FIG. 5).

The center leg 20 is most preferably circular in cross-section so that it has a diameter 22. This diameter 22 is preferably constant from a first end 24 of the center leg 20 to a second end 26. By forming the center leg 20 with a constant diameter 22, the center leg 20 can rest completely against the upper surface of one of the deck boards B during use (FIG. 1). Alternatively, the center leg 20 could be square in cross-section or could exhibit other cross-sectional forms. While this center leg 20 is shown with a diameter 22 which is generally similar to at least portions of the wider leg 40 and narrower leg 60, the diameter 22 (or other width dimension) of the center leg 20 could be greater or less than portions of the wider leg 40 and narrower leg 60 and still generally function according to this invention.

Most preferably, the entire positioning tool 10, including the center leg 20 and the wider leg 40 and narrower leg 60 are formed together from a unitary mass of material. This material can initially be a rod or very heavy gauge wire which has been bent to form the wider leg 40 and narrower leg 60 and appropriately pressed or ground to form the particular contours of the wider leg 40 and narrower leg 60, described in detail below. Alternatively, the entire tool 10 including the center leg 20, wider leg 40 and narrower leg 60 could be injection molded or cast from either a polymeric hydrocarbon material (i.e. polyethylene) or from a metal (i.e. aluminum or steel). Alternatively, the center leg 20 could be separately formed and then fastened, either in permanent fashion or removably, to the wider leg 40 and narrower leg 60. For instance, the center leg 20 could be fastened by welding or utilization of appropriate fasteners to secure the center leg 20 to the wider leg 40 and narrower leg 60. Both initial formation of the legs 20, 40, 60 together or utilization of fastening techniques to join separate legs 20, 40, 60 together are considered to be described by the term "affixed."

Figure 6:
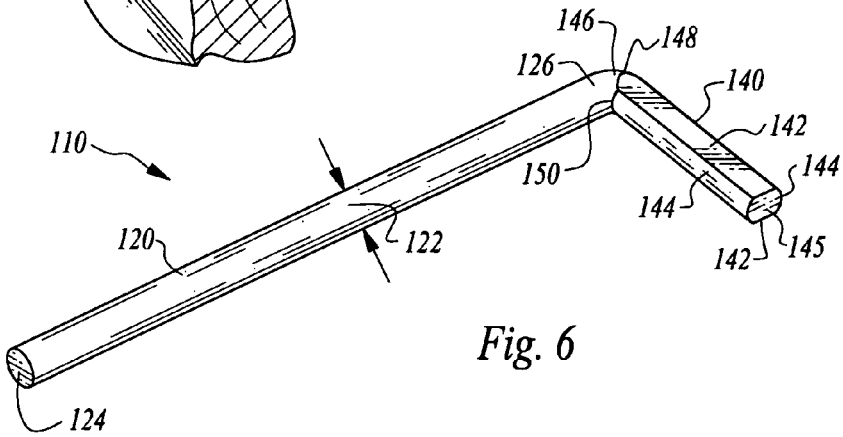
FIG. 6 is a perspective view of an alternative embodiment of the gap sizing tool of this invention in a simplified form where only one gap size is accommodated.
Figure 7:
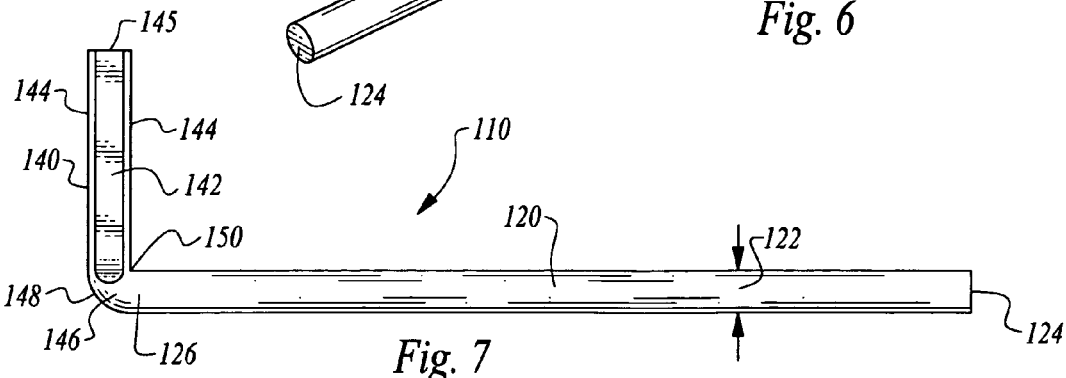
FIG. 7 is a top plan view of that which is shown in FIG. 6 and with the tool generally shown oriented rotated 180° from an orientation in which the alternative tool would typically be used.
Figure 8:
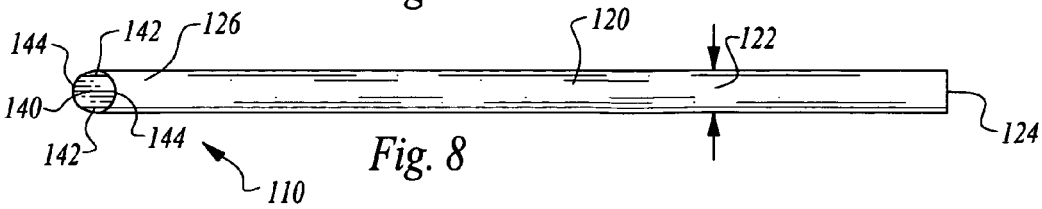
FIG. 8 is a front elevation view of that which is shown in FIG. 6.

With continuing reference to FIGS. 2-4, particular details of the wider leg 40 are described according to the preferred embodiment. The wider leg 40 provides a preferred form of secondary element for the positioning tool 10. This wider leg 40 could be provided alone along with the center leg 20, or also along with the narrower leg 60. While FIGS. 6-8 show an alternative embodiment positioning tool 110 which exhibits a leg having a width similar to that shown by the narrower leg 60 of the positioning tool 10, the relative nature of the terms "wider" and "narrower" lose significance with the alternative tool embodiment 110 as only one such gap sizing leg is provided, rather than two where one can be considered wider and the other considered narrower.

The wider leg 40 is preferably shorter than the center leg 20 and preferably has a length from a tip 45 to a bend 46 which is less than a width of typical "two by" dimensional lumber. For instance, approximately 1¼ inches long as measured from the inside corner where the wider leg 40 joins with the center leg 20. In this way, the wider leg 40 can optionally extend within the gap G down towards the joists J and directly over the joist J without touching the joists J. Alternatively, the wider leg 40 can be longer than a thickness of the deck boards B and located directly adjacent or spaced from the joists J. While the wider leg 40 is typically shorter than the center leg 20, it is conceivable that the wider leg 40 could be the same length as the center leg 20 or longer than the center leg 20 and still function according to this invention.

The wider leg 40 has sides thereof between the tip 45 and the bend 46 which are defined either by flats 42 or curves 44. The two flats 42 are preferably substantially parallel and opposite each other. The two curves 44 define remaining portions of the wider leg 40 between the flats 42.

The curves 44 preferably curve about a long axis of the wider leg 40 referenced as axis Y (FIG. 2) with the curves 44 defining a constant radius away from the axis Y. The flats 42 define portions of the wider leg 40 which are of lesser thickness between the two flats 42 than a greater thickness defined by a distance between the two curves 44 on opposite sides of the wider leg 40.

These curves 44 are spaced from each other in a first direction (along axis X) defining the greater thickness for the wider leg 40. This first direction and wider thickness define a gap width which is established when the positioning tool 10 is oriented with the wider leg 40 extending within the gap G and with the center leg 20 extending generally perpendicular to the gap G.

The curves 44 are sufficiently wide and curved about the axis Y so that the center leg 20 does not need to be oriented precisely perpendicular to the gap G, but rather can be skewed somewhat away from perpendicular (i.e. up to 45° or more away in either direction) and still have the curves 44 defining the width of the gap G having the same "greater thickness" in this first direction. Further rotation of the center leg 20 toward the gap G would cause the flats 42 to be the closest portions of the wider leg 40 to the boards B, and allow removal of the wider leg 40 and the remainder of the positioning tool 10 out of the gap G, such as after deck board B positioning has been completed.

At the bend 46, an outer corner 48 defines a transition from a portion of an outer one of the curves 44 to the center leg 20. This outer corner 48 can take on any convenient contour provided that sufficient strength is provided to prevent bending between the center leg 20 and wider leg 40. An inner corner 50 opposite the outer corner 48 is preferably a sharp 90° corner without appreciable rounding. In this way, the inner corner 50 can be directly adjacent a deck board B corner which is sharp with the center leg 20 resting upon a top surface of the deck board B. Other forms of relief can be provided adjacent the inner corner 50 so that at a minimum clearance is provided for such a sharp cornered deck board B, such as providing a large open space at the inside corner. Alternatively, where the deck boards B are beveled, it is not strictly necessary that this inner corner 50 be configured to provide clearance for a sharp cornered deck board B.

With continuing reference to FIGS. 2-4, particular details of the narrower leg 60 are described according to the preferred embodiment. The narrower leg 60 defines a preferred form of tertiary element for the positioning tool 10. This narrower leg 60 is most preferably affixed to the center leg 20 at an end of the center leg 20 opposite the wider leg 40. However, the narrower leg 60 could conceivably be located elsewhere on the center leg 20 including adjacent the wider leg 40 and still function according to this invention.

By making the narrower leg 60 perpendicular to both the center leg 20 and wider leg 40, the narrower leg 60 can lay flat on an upper surface of a deck board B when the wider leg 40 is extending vertically down into a gap G between adjacent deck boards B (and vice versa). However, the narrower leg 60 could be oriented non-perpendicular to the wider leg 40 and still provide the basic function of this invention.

The narrower leg 60 is preferably formed along with the wider leg 40 and center leg 20, such as by bending the positioning tool 10 out of a single rod of metal or other bendable material, or by injection molding to the finished shape. This narrower leg 60 preferably has a specialized cross-section similar to that described above with respect to the wider leg 40. In particular, the narrower leg 60 preferably includes a pair of flat faces 62 parallel and spaced from each other and curved sides 64 between the flat faces 62, with the flat faces 62 and curved sides 64 each extending from an end 65 to a bend 66 where the narrower leg 60 joins to the center leg 20. The narrower leg 60 also includes an outside corner 68 at the bend 66 and an inside corner 70 adjacent the bend 66.

The curved sides 64 of the narrower leg 60 define a first direction (along axis X of FIG. 2) having a greater thickness for the narrower leg 60 when the narrower leg 60 is viewed in cross-section perpendicular to a long axis of the narrower leg 60 along axis Z (FIG. 2).

In the most preferred form of this invention the center leg 20 is oriented along axis X, which is perpendicular to both axis Z for the narrower leg 60 and axis Y for the wider leg 40. Each of these axes X, Y, Z are mutually perpendicular to each other in this preferred embodiment. As with the wider leg 40, the outer corner 68 and inside corner 70 of the narrower leg 60 are configured to provide strength to the bend 66 and to accommodate deck boards B having sharp corners. In particular, the inside corner 70 preferably provides clearance for a deck board B having a 90° bend, either by the inside corner 70 itself having a sharp 90° bend or having enhanced clearance adjacent the inside corner 70.

Most preferably, the width of the wider leg 40 between the flats 42 is similar to the diameter 22 of the center leg 20. In this way, when the narrower leg 60 is extending into the gap G between adjacent deck boards B (FIG. 1) the entire center leg 20 and wider leg 40 can lay entirely flat adjacent an upper surface of the deck board B. Such an arrangement also minimizes the need for complex geometries adjacent the bend 46 between the wider leg 40 and the center leg 20. The curved sides 64 of the narrower leg 60 preferably have a thickness between each other that is similar to the diameter 22 of the center leg 20. This also tends to minimize the need for complex geometries between the narrower leg 60 and the center leg 20.

While the preferred embodiment for the positioning tool 10 is shown in FIGS. 2-4 and with the wider leg 40 and narrower leg 60 perpendicular to each other and at opposite ends of the center leg 20, it is conceivable that legs provided for sizing of the gap G could all extend perpendicularly from a common location on the center leg 20 and extend radially in different directions perpendicular from the center leg 20. More than two such gap legs could be provided extending radially away from the axis X of the center leg 20.

For instance, three separate gap legs could each extend from the center leg 20 at a common point on the center leg 20 with each of the three gap legs having a different thickness for gap G sizing. Each of these gap legs could also have flat faces and curved sides, or otherwise exhibit a greater thickness in a first direction than in a second direction with the first direction in a common plane with the center leg so that the general benefit of this invention can be extended to accommodate three different gap G sizes. It is also conceivable that up to four legs could extend radially from the center leg 20 with each of the four legs exhibiting different sizes.

In a most extreme extension of the general concept of this invention, up to six legs could extend radially from a center junction with each of the six gap legs having different sizes. In such a six gap leg embodiment, one of the six gap legs would extend down into the gap G between adjacent deck boards B, one of the six legs would extend up away from the surfaces of the deck boards B, and the other four legs would be oriented within a plane parallel with upper surfaces of the deck boards B. Any one of these four gap legs parallel with the upper surfaces of the deck boards B would be accessed to rotate such a tool so that the tool is changed from presenting curved sides for spacing of the gap G to presenting flat faces for removal of the tool. Lengths of such gap legs in such an embodiment could be of various different lengths or of common lengths.

With particular reference to FIGS. 6-8, particular details of an alternative embodiment gap sizing tool 110 are described. In the tool 110 of this embodiment, a simplified version of the positioning tool 10 of the preferred embodiment is described. This alternative tool 110 includes a long leg 120 generally similar to the center leg 20 of the tool 10 of the preferred embodiment. The long leg 120 thus includes a diameter 122 which is preferably substantially constant and the long leg 120 extends from a free end 124 to an attached end 126.

A short leg 140 extends from the attached end 126 of the long leg 120. This short leg 140 is generally similar in form to the narrower leg 60 or wider leg 40 of the tool 10 of the preferred embodiment. Thus, this short leg 140 includes flats 142 parallel and spaced from each other on opposite sides of the short leg 140. Curves 144 define remaining portions of the short leg 140. The curves 144 are substantially aligned within a common plane with the long leg 120 and define a particular gap size to be provided by this tool 110.

The short leg 140 extends from a tip 145 to a bend 146. At the bend 146 the short leg 140 joins the long leg 120. An outer corner 148 joins an outer one of the curves 144 to the long leg 120. An inner corner 150 joins an inner one of the curves 144 to the long leg 120. This inner corner 150 is preferably sharp in form or otherwise provided with relief so that the short leg 140 and long leg 120 can each be located adjacent perpendicular sides of a deck board B (FIG. 1) with a sharp substantially 90° corner. With this alternative tool 110, a simplified form of the positioning tool 10 is provided to simplify the construction in manufacturing of tools according to this invention and to also simplify the use of this invention.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified.

What is claimed is:

1. A tool for sizing a gap between deck boards or other objects, the tool comprising in combination:

an elongate primary element extending between a first end and a second end;

said primary element being substantially rigid;

an elongate secondary element;

said secondary element affixed to said primary element;

said secondary element having a cross-section perpendicular to a long axis thereof which exhibits a greater thickness in a first direction than a thickness exhibited in a second direction spaced from said first direction about said long axis of said secondary element; and said elongate primary element extending in said first direction, substantially common with said first direction in which said greater thickness of said cross-section of said elongate secondary element is exhibited, such that said greater thickness of said elongate secondary element extends in a substantially common direction with extension of said elongate primary element.

2. The tool of claim 1 wherein said secondary element is affixed to said primary element adjacent said first end of said primary element.

3. The tool of claim 1 wherein said primary element and said secondary element are formed together from a unitary mass of material.

4. The tool of claim 1 wherein said secondary element is substantially linear and substantially rigid.

5. The tool of claim 4 wherein said secondary element is oriented substantially perpendicular to said primary element.

6. The tool of claim 5 wherein said primary element is substantially linear.

7. The tool of claim 6 wherein said tool includes a tertiary element affixed to said primary element.

8. The tool of claim 7 wherein said tertiary element is substantially linear and oriented substantially perpendicular to said primary element.

9. The tool of claim 8 wherein said tertiary element is oriented substantially perpendicular to said secondary element and spaced from said secondary element.

10. The tool of claim 7 wherein said tertiary element has a cross-section perpendicular to a tertiary element long axis which exhibits a greater thickness in a first direction than a thickness exhibited in a second direction spaced from said first direction about said tertiary element long axis, and wherein a first direction thickness of said tertiary element is different from a first direction thickness of said secondary element.

11. The tool of claim 1 wherein an inner corner between said primary element and said secondary element is adapted to allow said primary element and said secondary element to lay flat against perpendicular sides of a board having a sharp substantially 90° corner.

12. The tool of claim 1 wherein said first direction of said cross-section of said secondary element terminates at a pair of opposing curved surfaces.

13. The tool of claim 12 wherein said opposing curved surfaces curve substantially about said long axis and with said opposing curved surfaces opposing each other in a plane substantially including said primary element therein.

14. The tool of claim 13 wherein said second direction of said cross-section of said secondary element terminates at substantially flat opposing surfaces which are substantially parallel to each other and closer to each other than a distance between said opposing curved surfaces.

15. A method for positioning deck boards with a uniform gap therebetween, the method including the steps of:

providing at least two gap sizing tools, each tool having an elongate primary element extending between a first end and a second end, the primary element being substantially rigid, an elongate secondary element, the secondary element affixed to the primary element, the secondary element having a cross-section perpendicular to a long axis thereof which exhibits a greater thickness in a first direction than a thickness exhibited in a second direction spaced from the first direction about the long axis of the secondary element;

positioning a first board where desired;

positioning a second board substantially parallel to said first board with a gap therebetween;

locating at least two of the gap sizing tools of said providing step with secondary elements thereof extending at least partially downwardly into the gap between the first board and the second board, with the primary elements of each of the gap sizing tools resting upon an upper surface of at least one of the boards;

orienting the at least two gap sizing tools with surfaces thereof defining the greater thickness in the first direction in the cross-section of the secondary element abutting each of the boards, such that a thickness of the gap matches the greater thickness in the first direction of the cross-section of the secondary elements;

fastening the boards to other portions of the deck; and removing the tools by:

first rotating each of the tools about the long axis of the secondary element; and second translating the tools along the long axis until the secondary element is out of the gap.

16. The method of claim 15 wherein said providing step includes the steps of:

forming the tool to include a tertiary element affixed to the primary element, wherein the tertiary element has a cross-section perpendicular to a tertiary element long axis of which exhibits a greater thickness in a first direction than a thickness exhibited in a second direction spaced from the first direction about the tertiary element long axis, and wherein a first direction thickness of the tertiary element is different from a first direction thickness of the secondary element;

selecting a gap width for the boards; and said orienting step including the step of selecting between the secondary element and the tertiary element for placement within the gap and between the first board and the second board.

17. A gap sizing tool, comprising in combination:

an elongate center leg;

said center leg being substantially rigid;

an elongate first gap leg affixed to said center leg and extending substantially perpendicular to said center leg;

an elongate second gap leg affixed to said center leg and extending substantially perpendicular to said center leg;

said second gap leg non-parallel with said first gap leg;

wherein said first gap leg has a cross-section perpendicular to a long axis of said first gap leg which exhibits a greater thickness in a first direction than a thickness exhibited in a second direction spaced from said first direction about said long axis of said first gap leg; and said center leg extending in said first direction, substantially common with said first direction in which said greater thickness of said cross-section of said elongate first gap leg is exhibited, such that said greater thickness of said elongate first gap leg extends in a substantially common direction with extension of said elongate first gap leg.

18. The gap sizing tool of claim 17 wherein said second gap leg is spaced from said first gap leg.

19. The gap sizing tool of claim 17 wherein said second gap leg is substantially perpendicular to said first gap leg.

20. The gap sizing tool of claim 17 wherein said second gap leg has a cross-section perpendicular to a second gap leg long axis which exhibits a greater thickness in a first direction than a thickness exhibited in a second direction spaced from said first direction about said second gap leg long axis, and wherein a first direction thickness of said second gap leg is different from a first direction thickness of said first gap leg.

* * * * *